United States Patent [19]

Lilburn

[11] 4,274,837

[45] Jun. 23, 1981

[54] DEPOSIT CONTROL ADDITIVES AND FUEL COMPOSITIONS CONTAINING THEM

[75] Inventor: Jennifer E. Lilburn, Berkeley, Calif.

[73] Assignee: Chevron Research Company, San Francisco, Calif.

[21] Appl. No.: 54,119

[22] Filed: Jul. 2, 1979

Related U.S. Application Data

[62] Division of Ser. No. 931,232, Aug. 8, 1978, Pat. No. 4,197,409.

[51] Int. Cl.[3] ..... C10L 1/22; C10L 1/18

[52] U.S. Cl. ..... 44/63; 44/64; 44/71; 44/72; 560/158; 560/159; 544/389; 544/398; 544/382; 544/400; 544/402; 260/239 A; 260/239 BC; 548/320

[58] Field of Search ..... 44/72, 71, 63, 64; 560/158, 159; 260/239 A, 239 BC; 544/398, 402; 548/320

[56] References Cited

U.S. PATENT DOCUMENTS

| | | | |
|---|---|---|---|
| 2,842,433 | 7/1958 | Newman et al. | 44/71 |
| 4,160,648 | 7/1979 | Lewis et al. | 44/71 |

*Primary Examiner*—Winston A. Douglas
*Assistant Examiner*—Jacqueline V. Howard
*Attorney, Agent, or Firm*—D. A. Newell; A. Stephen Zavell

[57] ABSTRACT

Fuel compositions for internal combustion engines are provided containing deposit control additives which maintain cleanliness of intake systems without contributing to combustion chamber deposits. The additives are hydrocarbylpoly(oxyalkylene) aminocarbamates comprising a hydrocarbyl-terminated poly(oxyalkylene) moiety composed of 2–5 carbon oxyalkylene units and one or more 9–30 carbon oxyalkylene groups. Certain additives also find use as dispersants in lubricating oils.

17 Claims, No Drawings

DEPOSIT CONTROL ADDITIVES AND FUEL COMPOSITIONS CONTAINING THEM

This is a division of application Ser. No. 931,232, filed Aug. 8, 1978 now U.S. Pat. No. 4,197,409.

BACKGROUND OF THE INVENTION

This application relates to novel hydrocarbylpoly(oxyalkylene) aminocarbamates which function as effective deposit control additives in fuels and dispersant additives in lubricating oils.

FIELD OF THE INVENTION

In recent years, numerous fuel detergents or "deposit control" additives have been developed. These materials when added to hydrocarbon fuels employed in internal combustion engines effectively reduce deposit formation which ordinarily occurs in carburetor ports, throttle bodies, venturies, intake ports and intake valves. The reduction of these deposit levels has resulted in increased engine efficiency and a reduction in the level of hydrocarbon and carbon monoxide emissions.

A complicating factor has, however, recently arisen. With the advent of automobile engines that require the use of non-leaded gasolines (to prevent disablement of catalytic converters used to reduce emissions), it is difficult to provide gasoline of high enough octane to prevent knocking and the concomitant damage which it causes. The difficulty is caused by octane requirement increase, herein called "ORI". ORI is caused by deposits formed in the combustion chamber while the engine is operating on commercial gasoline.

The basis of the ORI problem is as follows: each engine, when new, requires a certain minimum octane fuel in order to operate satisfactorily without pinging and/or knocking. As the engine is operated on any gasoline, this minimum octane increases and, in most cases, if the engine is operated on the same fuel for a prolonged period will reach equilibrium. This is apparently caused by an amount of deposits in the combustion chamber. Equilibrium is typically reached after 5000 to 15,000 miles of automobile operation.

Octane requirement increase, measured in a particular engine using commercial gasolines, will vary, at equilibrium, from 5 or 6 octane units to as high as 12 to 15 units, depending upon the gasoline compositions, engine design and type of operation. The seriousness of the problem is thus apparent. A typical 1975 or 1976 automobile with a research octane requirement of 85 when new may after a few months of operation require 97 research octane gasoline for proper operation, and little unleaded gasoline of that octane is available. The ORI problem exists in some degree with engines operated on leaded fuels. U.S. Pat. Nos. 3,144,311 and 3,146,203 disclose lead-containing fuel compositions having reduced ORI properties.

It is believed, however, by many experts that the ORI problem, while present with leaded gasolines, is much more serious with unleaded fuel because of the different nature of the deposits formed with the respective fuels, the size of increase, and because of the lesser availability of high-octane non-leaded fuels. This problem is compounded by the fact that the most common means of enhancing the octane of unleaded gasoline, increasing its aromatic content, also appears to increase the eventual octane requirement of the engine. The problem is compounded by the recently discovered fact that some of the presently used nitrogen-containing deposit control additives with mineral oil or polymer carriers appear to contribute significantly to the ORI of engines operated on unleaded fuel.

It is, therefore, highly desirable to provide fuel compositions containing deposit control additives which effectively control deposits in intake systems (carburetor, valves, etc.) of engines operated with fuels containing them, but which do not contribute to the combustion chamber deposits which cause increased octane requirements. Although, in general, deposit control fuel additives are not believed to be useful dispersants for lubricating oil compositions, certain carbamates are useful in this regard.

DESCRIPTION OF THE PRIOR ART

U.S. Pat. No. 3,359,303 discloses reaction products of polyalkyleneoxy alkyl 1-aziridine carboxylates with polyamines. These materials are disclosed as being curing agents (cross-linking agents) for epoxy resins. The alkyleneoxy chains contain a maximum of 20 alkyleneoxy units. U.S. Pat. No. 3,658,882 discloses certain aryl carbamates and quaternary derivatives thereof useful as antistatic agents. U.S. Pat. No. 3,786,081 describes compounds useful as crude oil demulsifiers which are bis-poly(oxyalkylene) derivatives of diisocyanates. U.S. Pat. No. 2,842,433 proposes a polyglycol dicarbamate ester of monoamine as an additive which reduces the deposit-forming tendencies of fuels. Belgian Pat. No. 855,962, a counterpart of U.S. Patent application Ser. Nos. 698,243; 700,922; 730,495 and 801,441, discloses and claims certain poly(oxyalkylene)aminocarbamates in fuel compositions. These compounds function as deposit control additives, maintaining engine intake system cleanliness without contributing to engine ORI. However, it has been found that carbamates containing certain poly(oxyalkylene) chains, when they are used in fuels employed in combination with certain lubricating oils, produce crankcase varnish. This does not occur when the poly(oxyalkylene) units of the aminocarbamates are derived from 1,2-epoxide monomers containing four or more carbon atoms. The $C_4$ or higher 1,2-epoxyalkanes provide oxyalkylene units with $C_2$ or higher alkyl side chains. It is desirable to provide compounds which have good deposit control characteristics, contribute little to ORI, are compatible in engine operation with a wide variety of crankcase lubricants, and are synthesized from low cost poly(oxyalkylene) alcohols, such as poly(oxypropylene) alcohol.

SUMMARY OF THE INVENTION

Aminocarbamate compounds derived from certain poly(oxyalkylene) chains are provided which have good deposit control characteristics in fuels, contribute little to engine ORI, and are compatible with most lubricating oil compositions. The compounds are hydrocarbylpoly(oxyalkylene) aminocarbamates, having at least one $C_1$-$C_{20}$ hydrocarbyl-terminated poly(oxyalkylene) chain. The poly(oxyalkylene) chain comprises 1 to 5 branched oxyalkylene units (e.g., oxy-1,2-alkylene units) each containing from 9 to 30 carbon atoms, as well as oxyalkylene units selected from 2 to 5 carbon oxyalkylene units which may be branched or linear. The aminocarbamates have molecular weights of from about 600 to 10,000, preferably from about 1000 to 5,000. The polyamine moiety of the aminocarbamate will contain at least one basic nitrogen atom, i.e., a nitrogen titratable by a strong acid.

DETAILED DESCRIPTION OF THE INVENTION

The poly(oxyalkylene) aminocarbamate of the present invention consists of an amine moiety and a poly(oxyalkylene) moiety comprising at least one hydrocarbyl-terminated poly(oxyalkylene) polymer bonded through a carbamate linkage, i.e., $$-OC(O)\overset{|}{N}-.$$

The amine component of the carbamate and the poly(oxyalkylene) component of the carbamate are selected to provide deposit control activity without octane requirement increase.

Preferred Amine Component

The amide moiety of the hydrocarbyl-terminated poly(oxyalkylene) aminocarbamate is preferably derived from a polyamine having from 2 to about 12 amine nitrogen atoms and from 2 to about 40 carbon atoms. The polyamine is preferably reacted with a hydrocarbylpoly(oxyalkylene) chloroformate to produce the hydrocarbylpoly(oxyalkylene) aminocarbamate fuel additive finding use within the scope of the present invention. The chloroformate is itself derived from hydrocarbylpoly(oxyalkylene) alcohol by reaction with phosgene. The polyamine, encompassing diamines, provides the product poly(oxyalkylene) aminocarbamate with, on the average, at least about one basic nitrogen atom per carbamate molecule, i.e., a nitrogen atom titratable by a strong acid. The polyamine preferably has a carbon-to-nitrogen ratio of from about 1:1 to about 10:1.

The polyamine may be substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower", as used in terms like lower alkyl or lower alkoxy, means a group containing from 1 to about 6 carbon atoms. At least one of the substituents on one of the basic nitrogen atoms of the polyamine is hydrogen, e.g., at least one of the basic nitrogen atoms of the polyamine is a primary or secondary amino nitrogen atom.

Hydrocarbyl, as used in describing all the components of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxy-isopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, 2-(2-ethoxyethoxy)ethyl, 2-(2-(2-ethoxyethoxy)ethoxy)ethyl, 3,6,9,12-tetraoxatetradecyl, 2-(2-ethoxyethoxy)hexyl, etc. The acyl groups of the aforementioned (C) substituents are such as propionyl, acetyl, etc. The more preferred substituents are hydrogen, $C_1$–$C_4$ alkyls and $C_1$–$C_4$ hydroxyalkyls.

In a substituted polyamine the substituents are found at any atom capable of receiving them. The substituted atoms, e.g., substituted nitrogen atoms, are generally geometrically inequivalent, and consequently the substituted amines finding use in the present invention can be mixtures of mono- and poly-substituted polyamines with substituent groups situated at equivalent and/or inequivalent atoms.

The more preferred polyamine finding use within the scope of the present invention is a polyalkylene polyamine, including alkylene diamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethyl-propylene, trimethylene, 1,3,2-hydroxypropylene, etc. Examples of such polyamines include ethylene diamine, diethylene triamine, di(trimethylene)triamine, dipropylene triamine, triethylene tetramine, tripropylene tetramine, tetraethylene pentamine, and pentaethylene hexamine. Such amines encompass isomers such as branched-chain polyamines and the previously mentioned substituted polyamines, including hydroxy- and hydrocarbyl-substituted polyamines. Among the polyalkylene polyamines, those containing 2–12 amine nitrogen atoms and 2–24 carbon atoms are especially preferred, and the $C_2$–$C_3$ alkylene polyamines are most preferred, in particular, the lower polyalkylene polyamines, e.g., ethylene diamine, dipropylene triamine, etc.

The amine component of the poly(oxyalkylene) aminocarbamate also may be derived from heterocyclic polyamines, heterocyclic substituted amines and substituted heterocyclic compounds, wherein the heterocycle comprises one or more 5–6 membered rings containing oxygen and/or nitrogen. Such heterocycles may be saturated or unsaturated and substituted with groups selected from the aforementioned (A), (B), (C) and (D). The heterocycles are exemplified by piperazines, such as 2-methylpiperazine, N-(2-hydroxyethyl)piperazine, 1,2-bis-(N-piperazinyl)ethane, and N,N'-bis(N-piperazinyl)piperazine, 2-methylimidazoline, 3-aminopiperidine, 2-aminopyridine, 2-(3-aminoethyl)-3-pyrroline, 3-aminopyrrolidine, N-(3-aminopropyl)-morpholine, etc. Among the heterocyclic compounds, the piperazines are preferred.

Typical polyamines that can be used to form the compounds of this invention by reaction with a poly(oxyalkylene)chloroformate include the following: ethylene diamine, 1,2-propylene diamine, 1,3-propylene diamine, diethylene triamine, triethylene tetramine, hexamethylene diamine, tetraethylene pentamine, dimethylaminopropylene diamine, N-(beta-aminoethyl)piperazine, N-(beta-aminoethyl)piperidine, 3-amino-N-ethylpiperidine, N-(beta-aminoethyl)morpholine, N,N'-di(beta-aminoethyl)piperazine, N,N'-di(beta-aminoethyl)imidazolidone-2, N-(beta-cyanoethyl)ethane-1,2-diamine, 1-amino-3,6,9-triazaoctadecane, 1-amino-3,6-diaza-9-oxadecane, N-(beta-aminoethyl)diethanolamine, N'-acetyl-N'-methyl-N-(beta-aminoethyl)ethane-1,2-diamine, N-acetonyl-1,2-propanediamine, N-(betanitroethyl)-1,3-propane diamine, 1,3-dimethyl-5-(beta-aminoethyl)hexahydrotriazine, N-(beta-aminoethyl)-hexahydrotriazine, 5-(beta-aminoethyl)-1,3,5-dioxazine, 2-(2-aminoethylamino)-ethanol, 2-[2-(2-aminoethylamino)ethylamino]-ethanol.

The amine component of the poly(oxyalkylene) aminocarbamate may also be derived from an amine-containing compound which is capable of reacting with a hydrocarbylpoly(oxyalkylene) alcohol to produce a hydrocarbylpoly(oxyalkylene) aminocarbamate having at least one basic nitrogen atom. For example, a substituted aminoisocyanate, such as $(R)_2NCH_2CH_2NCO$, wherein R is, for example, a hydrocarbyl group, reacts with the alcohol to produce the aminocarbamate additive finding use within the scope of the present invention. Typical aminoisocyanates that may be used to form the fuel additive compounds of this invention by reaction with a hydrocarbylpoly(oxyalkylene) alcohol include the following: N,N-(dimethyl-)aminoisocyanatoethane, generally, N,N-(dihydrocarbyl)aminoisocyanatoalkane, more generally, N-(perhydrocarbyl)isocyanatopolyalkylene polyamine, N,N-(dimethyl)aminoisocyanatobenzene, etc.

In many instances the amine used as a reactant in the production of the carbamate of the present invention is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine, substituted piperazines and pentaethylene hexamine, but the composition will be mainly tetraethylene pentamine and the empirical formula of the total amine composition will closely approximate that of tetraethylene pentamine. Finally, in preparing the compounds of this invention, where the various nitrogen atoms of the polyamine are not geometrically equivalent, several substitutional isomers are possible and are encompassed within the final product. Methods of preparation of amines, isocyanates and their reactions are detailed in Sidgewick's "The Organic Chemistry of Nitrogen," Clarendon Press, Oxford, 1966; Noller's "Chemistry of Organic Compounds," Saunders, Philadelphia, 2nd Ed. 1957; and Kirk-Othmer's "Encyclopedia of Chemical Technology," 2nd Ed., especially Volume 2, pp. 99–116.

Preferred Poly(oxyalkylene) Component

The hydrocarbyl-terminated poly(oxyalkylene) polymers which are utilized in preparing the carbamates of the present invention are monohydroxy compounds, i.e., alcohols, often termed monohydroxy polyethers, or polyalkylene glycol monohydrocarbylethers, or "capped" poly(oxyalkylene) glycols and are to be distinguished from the poly(oxyalkylene) glycols (diols), or polyols, which are not hydrocarbyl-terminated, i.e., not capped. The hydrocarbyl-terminated poly(oxyalkylene) alcohols are produced by the addition of alkylene oxides, such as oxirane, ethylene oxide, 1,2-epoxyhexadecane, propylene oxide, the butylene oxides, 1,3-epoxyalkane, or the pentylene oxides to the hydroxy compound ROH under polymerization conditions, wherein R is the hydrocarbyl group which caps the poly(oxyalkylene) chain. Methods of production and properties of these polymers are disclosed in U.S. Pat. Nos. 2,841,479 and 2,782,240, and the aforementioned Kirk-Othmer's "Encyclopedia of Chemical Technology," Volume 19, p. 507. In the polymerization reaction a single type of alkylene oxide may be employed, e.g., propylene oxide, in which case the product is a homopolymer, e.g., a poly(oxypropylene) alcohol. This alcohol will then be reacted with, for example, a $C_9$–$C_{30}$ 1,2-epoxyalkane, to make the hydrocarbylpoly(oxyalkylene) alcohol finding use within the scope of the present invention. Copolymers are equally satisfactory starting materials for the addition of a $C_9$–$C_{30}$ epoxide, and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention. Random polymers are more easily prepared when the reactivities of the oxides are relatively equal. In certain cases, when ethylene oxide is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, than the others in any order, or repetitively, under polymerization conditions. A particular block copolymer is represented by a polymer prepared by polymerizing propylene oxide on a suitable monohydroxy compound to form a poly(oxypropylene) alcohol and then polymerizing butylene oxide on the poly(oxypropylene) alcohol.

In general, the poly(oxyalkylene) polymers are mixtures of compounds that differ in polymer chain length. However, their properties closely approximate those of the polymer represented by the average composition and molecular weight.

The hydrocarbylpoly(oxyalkylene) moiety of the carbamate consists of one or more hydrocarbyl-terminated poly(oxyalkylene) polymers composed of oxyalkylene units containing from 2 to about 5 carbon atoms, and one or more 9–30 carbon branched oxyalkylene units. The polymers are bound to the aminocarbamate via the oxygen atom of carbamate linkages, and the poly(oxyalkylene) moiety consists of at least one such poly(oxyalkylene) polymer. The hydrocarbyl group contains from 1 to about 30 carbon atoms. Preferably the lower oxyalkylene units contain from 3 to 4 carbon atoms and the molecular weight of the hydrocarbyl poly(oxyalkylene) moiety is from about 500 to about 10,000, more preferably from about 500 to about 5,000. Each poly(oxyalkylene) polymer contains at least about 5 oxyalkylene units, preferably 8 to about 100 oxyalkylene units, more preferably about 10–100 units and most preferably 10 to about 25 such units. At least one of said oxyalkylene units is a 9–30 carbon oxyalkylene unit and as many as about 5 of said units may be 9–30 carbon branched oxyalkylene units. In general, the lower oxyalkylene units may be branched or unbranched. Preferably the poly(oxyalkylene) polymer chain contains at least some $C_3$–$C_5$ oxyalkylene units. A poly(oxyalkylene) polymer chain containing oxy(isopropylene) and ($C_9$–$C_{30}$ oxyalkylene) units is most preferred. The structures of the $C_3$–$C_5$ oxyalkylene units are any of the isomeric structures well known to the organic chemist, e.g., n-propylene, $—CH_2CH_2CH_2—$; isopropylene, $—C(CH_3)CH_2—$; n-butylene, $—CH_2CH_2CH_2CH_2—$; sec.-butylene, $—CH(CH_2CH_3)CH_2—$; tert.-butylene, $—C(CH_3)_2CH_2—$; disec.-butylene, $—CH(CH_3)CH(CH_3)—$; isobutylene, $—CH_2CH(CH_3)CH_2—$; etc. The preferred poly- (oxyalkylene) polymers contain branched lower oxyalkylene units, particularly oxy(isopropylene), and oxy(-sec.-butylene) units which are obtained from 1,2-propylene oxide and from 1,2-butylene oxide, respectively.

In a particularly preferred and useful embodiment of this invention, the lower oxyalkylene units are either $C_2$ or straight-chain $C_3$–$C_5$ or branched $C_3$ oxyalkylene units. For these particular lower oxyalkylene units the presence of the $C_9$–$C_{30}$ oxyalkylene unit so assists activity in hydrocarbon compositions that the carbamates are very effective deposit control additives without octane requirement increase.

At least one branched oxyalkylene unit composed of from about 9 to about 30 carbon atoms is present in the poly(oxyalkylene) polymer, and preferably from 1 to 5 such units are present in the poly(oxyalkylene) polymer. The 9–30 carbon oxyalkylene units may be found anywhere along the poly(oxyalkylene) chain, but preferably are located near the hydroxy (alcohol) terminus of the polymer rather than at the hydrocarbyl-terminated end. The 9–30 carbon branched oxyalkylene units may be derived from 1,2-epoxyalkanes, which in turn, may be derived from the epoxidation of olefins such as the cracked-wax olefins, but are generally derived from aliphatic, or aromatic epoxides which may be branched or linear, including combinations such as aralkyl epoxides. Preferably, the higher oxyalkylene units finding use within the scope of this invention are $C_{14}$–$C_{22}$ (more preferably, $C_{16}$–$C_{20}$) oxyalkylene units which are preferably derived from alpha-olefins. Examples of such epoxides include 1,2-epoxyhexadecane, 1,2-epoxydodecane, etc. The substantially linear 1,2-epoxides of about 14–22 carbon atoms are most preferred.

The hydrocarbyl moiety (R-) which terminates the poly(oxyalkylene) chain contains from 1 to about 30 carbon atoms, is generally derived from the monohydroxy compound (ROH) which is the initial site of the alkylene oxide addition in the polymerization reaction. Such monohydroxy compounds are preferably aliphatic or aromatic alcohols of from 1 to about 30 carbon atoms, more preferably an alkanol or an alkylphenol.

Preferred Hydrocarbylpoly(oxyalkylene) Aminocarbamate

Having described the amine component and the poly(oxyalkylene) component, the poly(oxyalkylene) aminocarbamate fuel additive of the present invention is obtained by linking these components together through a carbamate linkage, i.e., $$-O-C(O)-\overset{|}{N}-,$$

wherein the oxygen may be regarded as the terminal hydroxyl oxygen of the poly(oxyalkylene) alcohol component, and the carbonyl group, —C(O)—, is preferably provided by a coupling agent, e.g., phosgene. The aminocarbamate is a hydrocarbylpoly($C_2$–$C_5$ oxyalkylene)-($C_9$–$C_{30}$ oxyalkylene) aminocarbamate, e.g., butylpoly(oxypropylene)-(oxy-1,2-hexadecylene)-N-(2-aminoethyl) carbamate. In the preferred method of preparation, the hydrocarbylpoly(oxyalkylene) alcohol is reacted with phosgene to produce a hydrocarbylpoly(oxyalkylene) chloroformate. The chloroformate is reacted with a polyamine. The carbamate linkages are formed as the poly(oxyalkylene) chains are bound to the nitrogen of the polyamine through the oxycarbonyl group (—O—C(O)—) of the chloroformate. Since there may be more than one nitrogen atom of the polyamine which is capable of reacting with the chloroformate, the hydrocarbylpoly(oxyalkylene) aminocarbamate contains at least one hydrocarbylpoly(oxyalkylene) polymer chain bonded through an oxycarbonyl group to a nitrogen atom of the polyamine, but the carbamate may contain from 1 to 2 or more such chains. It is preferred that the hydrocarbylpoly(oxyalkylene) aminocarbamate product contain, on the average, about 1 poly(oxyalkylene) chain per molecule (i.e., mono carbamate), although it is understood that this reaction route may lead to mixtures containing appreciable amounts of di- or higher poly(oxyalkylene) chain substitution on a polyamine containing several reactive nitrogen atoms (i.e., dicarbamate or higher degree of substitution). To avert di- or higher substitution on the polyamine, a large excess of polyamine may be contacted with the chloroformate. Alternatively, a monoisocyanato-substituted amine may be reacted directly with the poly(oxyalkylene) alcohol. The dicarbamate produced by the reaction of a polyamine with two molecules of hydrocarbylpoly(oxyalkylene) chloroformate is to be distinguished from the dicarbamate produced by the reaction of a poly(oxyalkylene) di(chloroformate) with two moles of the same polyamine. For purposes of distinction, the latter dicarbamate will be called the "bis(aminocarbamate)", and the former simply "dicarbamate". The bis(aminocarbamate), i.e., that derived from a poly(oxyalkylene) glycol, has been shown to be deleterious in fuel compositions, while the dicarbamate, i.e., that produced from the hydrocarbyl-terminated poly(oxyalkylene) alcohol, is at best an ineffective deposit control additive in fuel compositions.

The hydrocarbylpoly(oxyalkylene) aminocarbamate finding use within the scope of the present invention is characterized by having at least about one basic nitrogen atom per molecule. Since, within the compositional mixture, the amine moiety may contain more or less nitrogen, and consequently the poly(oxyalkylene) moiety of the carbamate may contain more than one poly(oxylakylene) polymer, the aminocarbamate is further characterized by having, on the average, at least one basic nitrogen atom per aminocarbamate molecule. A "basic nitrogen atom" is one that is titratable by a strong acid, e.g., a primary, secondary or tertiary amino nitrogen, as distinguished from, for example, amido nitrogens, $$-\overset{|}{N}-C(O)-,$$

which are not so titratable. Preferably, at least one of the basic nitrogen atoms is in a primary or secondary amino group.

The hydrocarbylpoly(oxyalkylene) aminocarbamate has a molecular weight of from about 600 to about 10,000 (representing an average maximum disubstitution of poly(oxyalkylene) polymer in the carbamate) and preferably from about 1,000 to about 5,000.

A class of preferred carbamates may be described by the following general formula:

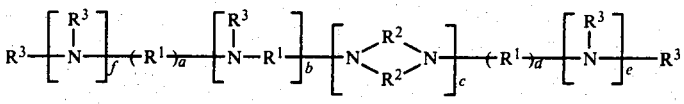

wherein two $R^3$ groups attached to the same nitrogen atom may form a 5 or 6 membered saturated or unsaturated nitrogen heterocyclic radical, such as pyrrolyl, pyrrolidinyl, imidazolidinyl, oxazolidinyl, pyrrolinyl, imidazolinyl, piperidino, piperazinyl, isoxazolyl, hexahydrotriazinyl, triazinyl, morpholino, etc.; wherein said heterocyclic radical may be substituted with substituents selected from the aforementioned (A), (B), (C) and (D) groups of substituents. The remaining $R^3$ groups are the same or different substituents selected from the aforementioned (A), (B), (C) and (D) groups of substituents and a poly(oxyalkylene) oxycarbonyl group of the formula:

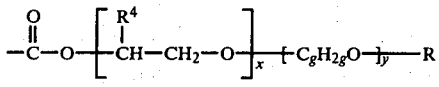

in which g is an integer from 2 to 5, x is an integer from 1 to 5; y is an integer such that the molecular weight of the poly(oxyalkylene) oxycarbonyl group is from about 500 to about 5,000, i.e., y is at least about 5 and preferably from 8 to about 100, R is a hydrocarbyl group of from 1 to 30 carbon atoms, and $R^4$ is a hydrocarbyl group of from 7 to 28 carbon atoms, and preferably an alkyl group. $R^1$ is the same or different alkylene, carbonyl, oxycarbonyl, or hydroxy-substituted alkylene radical of from 2 to 6 carbon atoms, $R^2$ is carbonyl, alkylene carbonyl or alkylene of from 2 to 4 carbon atoms with vicinal linkages. At least one, and preferably no more than one, of the $R^3$ groups is the said poly(oxyalkylene) oxycarbonyl group. Preferably all the $R^3$ groups, other than one poly(oxyalkylene) oxycarbonyl group, are selected from H, $C_1$–$C_6$ alkyl and $C_1$–$C_6$ hydroxy alkyl. $R^3$, $R^1$ and $R^2$ are selected such that at least one nitrogen atom is a basic nitrogen atom, i.e., titratable with strong acid. a is 0 or 1, preferably 1; b is an integer from 0 to 4, preferably 0 to 2; c is 0 or 1, preferably 0; d is 0 or 1, preferably 0; e is 0 or 1, preferably 1; and f is 0 or 1, and equal to 1 when c is 0. It is also provided that the sum of f+b+2c+e is equal to or greater than 2.

Preparation of the Poly(oxyalkylene) Amino Carbamates

The additives of this invention may be most conveniently prepared, as has been previously noted, by reaction of phosgene with the monohydroxy poly(oxyalkylene) alcohol (itself prepared by reaction of a hydrocarbyl poly(lower-oxyalkylene) alcohol with a $C_9$–$C_{30}$ epoxide) followed by reaction of the product with a suitable amine.

Bis(aminocarbamates), which we have made by reacting phosgene with an "uncapped" poly(oxyalkylene) diol followed by reaction with polyamine, have been found to have no deposit control activity.

The hydrocarbylpoly(lower-oxyalkylene) alcohol is reacted with the $C_9$–$C_{30}$ epoxide employing usually an excess of from 0.1 to 5 molar excess of the epoxide. It is preferred that an average of about one epoxide per molecule be incorporated in the poly(oxyalkylene). Some of the compounds, however, will contain a plurality usually up to 5 or more of the $C_9$–$C_{30}$ oxyalkylene units. The presence of a basic catalyst is preferred. Usually from about 0.1 to 1.0 mol of catalyst such as an alkali metal or alkali metal hydroxide is used. The reaction is carried out at temperatures of from about 50° to 120° C., preferably from about 80° to 110° C. The reaction will usually take from about ¼ to 48 hours.

The reaction of the poly(oxyalkylene) monools thus prepared with phosgene is usually carried out on an essentially equimolar basis, although excess phosgene can be used to increase the degree of reaction. The reaction may be carried out at temperatures from −10° to 100° C., preferably in the range of 0° to 50° C. The reaction will usually be complete within ¼ to 24 hours. Times of reaction will usually be in the range of from 2 to 10 hours. Excess phosgene is removed after chloroformylation.

A solvent may be used in the chloroformylation reaction. Suitable solvents include benzene, toluene, etc.

The reaction of the resultant chloroformate with the amine may be carried out neat or, preferably, in solution. Temperatures of from −10° to 200° C. may be utilized. The desired product may be obtained by water wash and stripping, usually by the aid of vacuum, of any residual solvent.

The mol ratio of the basic amine nitrogen to the poly(oxyalkylene) chloroformates will generally be in the range from about 2 to 20 mols of basic amine nitrogen per mol of chloroformate, and more usually 5 to 15 mols of basic amine nitrogen per mol of chloroformate. The mol ratio will depend upon the particular amine and the desired ratio of polyether to amine. Since suppression of polysubstitution of the alkylene polyamines is usually desired, large mol excesses of the amine will be used.

The reaction or reactions may be conducted with or without the presence of a reaction solvent. A reaction solvent is generally employed whenever necessary to reduce the viscosity of the reaction product. These solvents should be stable and inert to the reactants and reaction product. Preferred solvents include aliphatic or aromatic hydrocarbons. Depending on the temperature of the reaction, the particular chloroformate used, the mol ratios and the particular amine, as well as the reactant concentrations, the reaction time may vary from less than 1 minute to 3 hours.

After the reaction has been carried out for a sufficient length of time, the reaction mixture may be subjected to extraction with a water-hydrocarbon or a water-hydrocarbon-alcohol medium to free the product from any low-molecular weight amine salts which have formed and any unreacted alkylene polyamines. The product may then be isolated by evaporation of the solvent. Small amounts of halogen may be present as the hydrohalide salt of the polyether aminocarbamates.

Depending on the particular application of the composition of this invention, the reaction may be carried out in the medium in which it will ultimately find use, e.g. polyether carriers or an oleophilic organic solvent or mixtures thereof and be formed at concentrations which provide a concentrate of the detergent composition. Thus, the final mixture may be in a form to be used directly for blending in fuels.

Although the fuel additive of the present invention has been described in terms of amine and poly(oxylakylene) components coupled via a chloroformylation reaction utilizing phosgene, as is known to those of skill in the art, there are other methods of preparing carbamates which use other reactants. For example, the reaction of an isocyanate with an alcohol such as the hydrocarbylpoly(oxyalkylene) alcohol described above also produces a carbamate. Monoisocyanato amines are produced, for example, by the methods of U.S. Pat. No. 3,644,490. Consequently, it is, for example, within the skill of the art to use a selected isocyanate-substituted amine or polyamine to react directly with said poly(oxyalkylene) alcohol to produce a carbamate within the scope of the present invention. This route may be exemplified by the reaction of $(CH_3)_2NCH_2CH_2N{=}C{=}O$ with a hydrocarbylpoly(oxyalkylene) alcohol to produce a carbamate characteristic of the present invention.

Fuel Compositions

The aminocarbamates of this invention will generally be employed in a hydrocarbon distillate fuel. The proper concentration of additive necessary in order to achieve the desired detergency and dispersancy varies depending upon the type of fuel employed, the presence of other detergents, dispersants and other additives, etc. Generally, however, from 30 to 2000 weight parts per million, preferably from 100 to 500 ppm of aminocarbamate per part of base fuel is needed to achieve the best results. When other detergents are present, a lesser amount of aminocarbamate may be used. For performance as a carburetor detergent only, lower concentrations, for example 30 to 70 parts per million may be preferred.

The deposit control additive may be formulated as a concentrate, using an inert stable oleophilic organic solvent boiling in the range of about 150° to 400° F. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the fuel additive. In the concentrate, the amount of the additive will be ordinarily at least 10 percent by weight and generally not exceed 70 percent by weight and preferably from 10 to 25 weight percent.

In gasoline fuels, other fuel additives may also be included such as antiknock agents, e.g., methylcyclopentadienyl manganese tricarbonyl, tetramethyl or tetraethyl lead, or other dispersants or detergents such as various substituted succinimides, amines, etc. Also included may be lead scavengers such as aryl halides, e.g., dichlorobenzene or alkyl halides, e.g., ethylene dibromide. Additionally, antioxidants, metal deactivators and demulsifiers may be present.

A particularly useful additive is a fuel-soluble carrier oil. Exemplary carrier oils include nonvolatile poly(oxyalkylene) compounds; other synthetic lubricants or lubricating mineral oil. Particularly preferred carrier oils are poly(oxyalkylene) alcohols, diols (glycols) and polyols used singly or in mixtures, such as the Pluronics marketed by BASF Wyandotte Corp., and the UCON LB-series fluids marketed by Union Carbide Corp. When used, these oils are believed to act as a carrier for the additive and assist in removing and retarding deposits. They have been found to display synergistic effects when combined with certain polyether aminocarbamates. They are employed in amounts from about 0.005 to 0.5 percent by volume, based on the final gasoline composition. Preferably 100–5,000 ppm by weight of a fuel soluble poly(oxyalkylene) alcohol, glycol or polyol is used as a carrier oil.

Although it is not generally correct that fuel deposit control additives can be used as dispersant lubricating oil additives, aminocarbamates do find additional use as dispersant additives in lubricating oils. Suitable oils are any commonly employed oils including paraffinic, naphthenic, halo-substituted hydrocarbons, synthetic esters or combinations thereof. Oils of lubricating viscosity have viscosities in the range of 35 to 50,000 SUS at 100° F., and more usually from about 50 to 10,000 SUS at 100° F. The amount of the aminocarbamate of this invention which is incorporated into the lubricating oil to provide the effective amount necessary for dispersancy varies widely with the particular amino carbamate used as well as the use intended for the lubricating oil composition. Other conventional additives which can be used in combination with the amino carbamate, include ashless dispersants such as the type disclosed in U.S. Pat. Nos. 3,172,892, 3,219,666, 3,381,022; neutral and basic calcium, barium and magnesium petrosulfonates or alkyl phenates; oxidation inhibitors, antifoam agents, viscosity index improvers, pour-point depressants, and the like, such as chlorinated wax, benzyldisulfide, sulfurized sperm oil, sulfurized terpene; phosphorus esters such as trihydrrocarbon phosphites and phosphates; metal thiocarbamates such as zinc dioctyldithiocarbamate; metal phosphorus dithioates such as zinc dioctylphosphorodithioate; polyisobutene having an average molecular weight of 100,000; etc. In general, the lubricating oil compositions will contain from about 0.01 to about 10% or 20% weight of said oil-soluble carbamate. More usually, the lubricating oil composition of the invention will contain from about 0.5 to about 10% weight, and more usually from about 1 to about 8%, of the hydrocarbylpoly(oxyalkylene) aminocarbamate. The lubricating oil compositions of the invention are useful for lubricating internal combustion engines. The lubricating oils not only lubricate the engine, but, because of their dispersancy properties, help maintain a high degree of cleanliness of the lubricated parts.

In a second embodiment of this invention, lubricating oil additive concentrates are provided comprising from about 90 to about 20 weight percent of an inert stable oleophilic solvent such as oil of lubricating viscosity and from about 10 to about 80 weight percent of the poly(oxyalkylene) aminocarbamates of this invention. Typically, the concentrates contain sufficient diluent to make them easy to handle during shipping and storage. Preferably, the diluent is an oil of lubricating viscosity so that the concentrate may be readily mixed with lubricating oils to prepare lubricating oil compositions. Suitable lubricating oils which can be used as diluents typically have viscosities in the range from about 35 to about 1000 Saybolt Universal Seconds (SUS) at 100° F., although any oil of lubricating viscosity can be used.

EXEMPLIFICATION

The following examples are presented to illustrate specific embodiments of the practice of this invention and should not be interpreted as limitations upon the scope of the invention.

EXAMPLE 1

Preparation of Oleylpoly(oxypropylene) ($C_{11}$–$C_{14}$ Oxyalkylene) Alcohol In dry glassware equipped with heater, stirrer, nitrogen inlet and thermometer, 500 g (0.33 mol) of an oleyl-capped poly(oxypropylene) monool (MW 1524) was combined with 300 ml of toluene and reacted with 4.28 g (0.11 mol) of potassium. The mixture was stirred for 20 hours at 100° C.

The mixture was stirred and a 94 g portion (about 0.49 mol) of straight chain $C_{11}$–$C_{14}$ terminal epoxides was added dropwise. The mixture was stirred and heated at 111° C. under reflux for 24 hours. The mixture was then extracted into 700 ml of n-butanol and washed five times with 300 ml aliquots of hot water. The solvent was removed under reduced pressure yielding 570 g of a colorless oil having an average molecular weight of 1318 and hydroxyl number of 28. NMR analysis of the fluoroacetate-derivatives indicated that about 25% of the olelylpoly(oxypropylene) alcohol did not react with the $C_{14}$–$C_{14}$ 1,2-epoxides.

EXAMPLE 2

Preparation of Poly(oxypropylene) Chloroformate

Glassware as in Example 1 was employed. 75 ml (1.05 mol) of phosgene was condensed and added to 250 ml of toluene which had been cooled in an ice bath to 2° C. The solution was stirred, and 550 g of the product of Example 1 was added dropwise. The mixture was allowed to warm to room temperature and stirred overnight. The mixture was heated and stirred to a maximum temperature of 120° C. 50 cc of toluene were distilled off to ensure removal of excess phosgene. The product showed a typical carbonyl stretch in the IR spectrum at 1785 $cm^{-1}$.

EXAMPLE 3

Preparation of Poly(oxypropylene)($C_{11}$–$C_{14}$ Oxyalkylene) Aminocarbamates The product of Example 2 was diluted to 1400 ml with toluene. Ethylene diamine (EDA) was pumped through a Komex mixing tube with the diluted chloroformate at respective rates such that a 7.5 fold excess of amine was present during the reaction. The total rate was 1050 ml/min. The product was extracted into 1 L of n-butanol and washed 10 times with 300 ml aliquots of hot water. The solvent was removed under reduced pressure yielding 528 g of a yellow oil, of average molecular weight 1421 containing 0.59% basic nitrogen and 1.35% total nitrogen.

EXAMPLE 4

Preparation of a Poly(oxypropylene)-1,2-epoxyhexadecane Reaction Product

Using apparatus as described in Example 1, 500 g (0.42 mol) of a n-butyl-capped poly(oxypropylene) alcohol (mol weight 1250) was combined with 300 ml of toluene and 4.82 g (0.12 mol) of potassium. After 2 hours of stirring at 100° C., the potassium was no longer visible. 133.4 g (0.56 mol) of 1,2-epoxyhexadecane was added to the mixture which was then refluxed for 24 hours.

350 ml of Bio-Rad-HG 50W-X2 resin was added to purify the mixture and the mixture was stirred for one hour at 80° C. The mixture was filtered to remove the resin and the solvent was removed under reduced pressure. The product (588 g) was a translucent yellow oil having an average mol weight of 1306 and a hydroxyl number of 29.

EXAMPLE 5

Preparation of Butylpoly(oxypropylene)-(oxy-1,2-hexadecylene)-N-(2-aminoethyl) carbamate Following the procedures set forth in Examples 2 and 3, the product of Example 4 was chloroformylated with phosgene and reacted with ethylene diamine to produce a material of average molecular weight 1385 and containing 0.60% basic nitrogen and 1.37% total nitrogen, which was mostly the desired butylpoly(oxypropylene)-(oxy-1,2-hexadecylene) ethylene diamine carbamate with minor amounts each of aminocarbamates derived from the butylpoly(oxypropylene) monool alone and the $C_{16}$ epoxide alone.

EXAMPLE 6

Following the procedures of Examples 1–5, corresponding aminocarbamates were prepared from combinations of various capped poly(oxypropylenes) and epoxides. The epoxides included mixtures of $C_6$–$C_9$ linear epoxides, $C_{11}$–$C_{14}$ linear epoxides and $C_{16}$ linear epoxide.

The following compounds are identified for Tables I and II. Each is a carbamate of ethylene diamine (EDA) prepared according to the foregoing examples.

| | Lower poly(oxyalkylene) | Linear 1,2-Epoxide | Amine |
|---|---|---|---|
| Compound 1 | 1350 Mw butyl-capped | $C_6$–$C_9$ | EDA |
| Compound 2 | 1350 Mw butyl-capped | $C_{11}$–$C_{14}$ | " |
| Compound 3 | 1350 Mw butyl-capped | $C_{16}$ | " |
| Compound 4 | 1525 Mw oleyl-capped | $C_{11}$–$C_{14}$ | " |
| Compound 5 | 1800 Mw butyl-capped | $C_{16}$ | " |

In the following tests the poly(oxypropylene) aminocarbamates of this invention were blended in gasoline and their deposit reducing capacity tested in an ASTM/CFR Single-Cylinder Engine Test.

In carrying out the tests, a Waukesha CFR single-cylinder engine is used. The run is carried out for 15 hours, at the end of which time the intake valve is removed, washed with hexane and weighed. The previously determined weight of the clean valve is subtracted from the weight of the valve. The difference between the two weights is the weight of the deposit with a lesser amount of deposit measured connoting a superior additive. The operating conditions of the test are as follows: water jacket temperature 100° C. (212° F.); manifold vacuum of 12 in Hg, intake mixture temperature of 50.2° C. (125° F.); air-fuel ratio of 12; ignition spark timing of 40° BTC; engine speed is 1800 rpm; the crankcase oil is a commercial 30W oil. The amount of carbonaceous deposit in milligrams on the intake valves is measured and reported in the following Table I.

The base fuel tested in the above test is a regular octane unleaded gasoline containing no fuel deposit control additive. The base fuel in each test run is admixed with 400 ppm of the deposit control additive and 200 ppm of poly(oxypropylene) monobutylether (molecular weight about 1450).

TABLE I

| Additive Description | Intake Valve Deposit Tests[1] Average Washed Deposit, mg 11A Engine | 12A Engine |
|---|---|---|
| Base Fuel alone | 259[2] | 103[3] |
| Compound 2 | 10 | 16 |
| Compound 3 | 8 | 26 |
| Compound 4 | 71 | 28 |

[1]Singe evaluations unless noted.
[2]Average of 8 runs.
[3]Average of 4 runs.

The above results show the significant reduction in valve deposits achieved by the test compounds compared with base fuel.

In addition to their use as fuel additives, because of their good oil solubility, the compounds of this invention are particularly suitable for use as lubricating oil dispersants. For this use they are employed in amounts sufficient to provide dispersancy, usually from about 0.01 to 10 percent by weight, preferably from about 0.5 to 10 percent by weight, in the lubricating oil composition.

The additives were evaluated in a laboratory dispersancy test. The hexane-insoluble, chloroform-soluble portion of sludge scraped from the crankcase of high mileage engines was added as a chloroform solution to a typical base gasoline containing varying amounts of the test additive. The concentration of additive necessary to prevent coagulation and precipitation of the sludge for at least 20 minutes was measured.

Table II sets forth these results:

TABLE II

| Compound No. | Conc. ppm |
|---|---|
| 1 | 800 |
| 2 | 800 |
| 3 | 800 |
| 4 | 800 |
| 5 | 1600 |

The above data indicate that all of these additives are effective dispersants.

Although many specific embodiments of the invention have been described in detail, it should be understood that the invention is to be given the broadest possible interpretation within the terms of the following claims.

What is claimed is:

1. A fuel composition comprising a major amount of hydrocarbons boiling in the gasoline range and from 30 to 2,000 ppm of the deposit control additive hydrocarbylpoly(oxyalkylene) aminocarbamate having a molecular weight of from about 600 to 10,000, at least one $C_1$–$C_{30}$ hydrocarbyl-terminated poly(oxyalkylene) chain and at least one basic nitrogen atom;

wherein said poly(oxyalkylene) chain comprises from one to five oxylkylene units each containing from 9 to 30 carbon atoms and other oxyalkylene units selected from 2 to 5 carbon oxyalkylene units.

2. The composition of claim 1 in which at least one of said basic nitrogen atoms in said aminocarbamate is in a primary or secondary amino group.

3. The composition of claim 2 in which said aminocarbamate is of molecular weight from 600 to 5,000; contains one poly(oxyalkylene) chain; said poly(oxyalkylene) chain comprises oxyalkylene units selected from $C_2$ oxyalkylene units, $C_3$–$C_5$ straight chain oxyalkylene units and branched chain $C_3$ oxyalkylene units; and said poly(oxyalkylene) chain contains one to five ($C_9$–$C_{30}$) oxyalkylene units.

4. The composition of claim 3 in which said poly(oxyalkylene) chain comprises oxypropylene units and one to five oxyalkylene units of about 14–22 carbon atoms each.

5. The composition of claim 1 in which said aminocarbamate is hydrocarbylpoly($C_2$–$C_5$ oxyalkylene)-($C_9C_{30}$ oxy-1,2-alkylene) aminocarbamate.

6. The composition of claim 5 in which said aminocarbamate in hydrocarbylpoly(oxypropylene) ($C_{14}$–$C_{22}$ oxy-1,2-alkylene)-N-(2-aminoethyl) carbamate.

7. The composition of claim 1 in which the amine moiety of said aminocarbamate is derived from a polyamine having from 2 to 12 amine nitrogen atoms and from 2 to 40 carbon atoms with a carbon:nitrogen ratio between 1:1 and 10:1.

8. The composition of claim 7 in which said polyamine is a polyalkylene polyamine wherein the alkylene group contains from 2 to 6 carbon atoms and the polyamine contains 2 to 12 amine nitrogen atoms and 2 to 24 carbon atoms.

9. The composition of claim 8 in which said polyamine is ethylene diamine.

10. A fuel composition comprising a major amount of hydrocarbon boiling in the gasoline range and from 30 to 2,000 ppm of a deposit control compound of the formula:

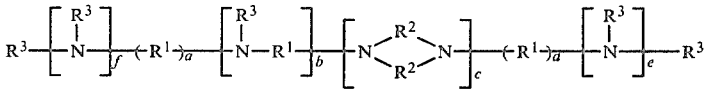

wherein two $R^3$ groups attached to the same nitrogen atom and taken together with said nitrogen atom may form a 5 or 6 membered saturated or unsaturated nitrogen heterocyclic radical; wherein said heterocyclic radical may be substituted with substituents selected from: (A) hydrogen; (B) hydrocarbyl groups of from 1 to 10 carbon atoms; (C) acyl groups of from 2 to 10 carbon atoms; and (D) monoketo, monohydroxy, mononitro, monocyano, lower alkyl and lower alkoxy derivatives of the substituents of (B) and (C); wherein the remaining $R^3$ groups are the same or different substituents selected from (A), (B), (C), (D) and poly(oxyalkylene) oxycarbonyl groups of the formula:

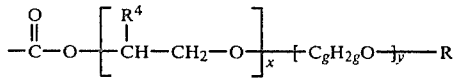

in which g is an integer from 2 to 5, x is an integer from 1 to 5; y is an integer such that the molecular weight of the poly(oxyalkylene) oxycarbonyl group is from about 500 to about 5,000; R is a hydrocarbyl group of from 1 to 30 carbon atoms; and $R^4$ is a hydrocarbyl group of from 7 to 28 carbon atoms; wherein the $R^1$ are the same or different alkylene, carbonyl, oxycarbonyl, or hydroxy-substituted alkylene radical of from 2 to 6 carbon atoms, and $R^2$ is carbonyl, alkylene carbonyl or alkylene of 2 to 4 carbon atoms with vicinal linkages; wherein at least one of the $R^3$ groups is said poly(oxyalkylene) oxycarbonyl group; wherein $R^3$, $R^1$ and $R^2$ are selected such that at least one nitrogen atom is a basic nitrogen atom; and wherein a is 0 or 1, b is an integer 0 to 4, c is 0 or 1, d is 0 or 1, e is 0 or 1, f is 0 or 1 and equal to 1 when c is 0, and the sum $f+b+2c+e$ is equal to or greater than 2.

11. The composition of claim 10 in which x, f, a, and e are each equal to 1 and c and d are each 0.

12. The composition of claim 11 in which all the $R^3$ groups, other than one poly(oxyalkylene) oxycarbonyl group, are selected from H, $C_1$–$C_6$ alkyl and $C_1$–$C_6$ hydroxyalkyl.

13. The composition of claim 12 in which $R^1$ is propylene.

14. The composition of claim 12 in which $R^1$ is ethylene.

15. A concentrate comprising an inert stable oleophilic organic solvent boiling in the range of about 150° to 400° F. and from about 10 to 25 weight percent of the deposit control additive hydrocarbyl poly (oxyalkylene) aminocarbamate having a molecular weight of from about 600 to 10,000, at least one $C_1$–$C_{30}$ hydrocarbyl-terminated poly (oxyalkylene) chain and at least one basic nitrogen atom; wherein said poly (oxyalkylene) chain comprises from one to five oxyalkylene units each containing from 9 to 30 carbon atoms and other oxyalkylene units selected from 2 to 5 carbon oxyalkylene units.

16. A concentrate according to claim 15 where there is also present 5 to 80 weight percent of a poly(oxyalkylene) alcohol, glycol or polyol.

17. The fuel composition of claim 1 or claim 10 which contains in addition from 100 to 5,000 ppm of a fuel-soluble poly(oxyalkylene) alcohol, glycol or polyol.

* * * * *